United States Patent [19]

Reider

[11] 4,218,020

[45] Aug. 19, 1980

[54] ELLIPTICAL AIRBLAST NOZZLE

[75] Inventor: Samuel B. Reider, Indianapolis, Ind.

[73] Assignee: General Motors Corporation, Detroit, Mich.

[21] Appl. No.: 14,709

[22] Filed: Feb. 23, 1979

[51] Int. Cl.[2] ..... B05B 1/04; B05B 7/00

[52] U.S. Cl. ..... 239/406; 239/599; 239/601; 60/740

[58] Field of Search ..... 239/405, 406, 597, 599, 239/601; 60/39.72 R, 39.74 R

[56] References Cited

U.S. PATENT DOCUMENTS

| | | | |
|---|---|---|---|
| 3,521,824 | 7/1970 | Wilcox | 239/424.5 |
| 3,615,051 | 10/1971 | Gettig et al. | 239/406 |
| 3,702,175 | 11/1972 | Watkins | 239/597 X |
| 3,713,588 | 1/1973 | Sharpe | 239/400 |
| 3,754,710 | 8/1973 | Chimura | 239/597 |
| 3,759,448 | 9/1973 | Watkins | 239/419.5 |

*Primary Examiner*—Robert W. Saifer
*Attorney, Agent, or Firm*—J. C. Evans

[57] ABSTRACT

An airblast atomizer with air swirl vanes has an outlet configured to produce a fuel/air mixture pattern from the fuel nozzle to match an annular combustion chamber formed between an annular inner combustor wall and an annular combustor wall having inlet ends thereof connected to an annular dome for supporting each of a plurality of the fuel nozzles; each of the nozzles including a pair of spaced, large radius slots in a cylindrical outlet wall of the nozzle operative to produce a vortex pattern that will spread the mixed fuel/air pattern from the nozzle to define the major axis of an elliptically formed fuel/air pattern from the nozzle and wherein the remainder of the airblast atomizer nozzle has a reduced radius to conform the fuel/air mixture to the diameter of an outlet swirl chamber from the nozzle to produce the minor axis of an elliptically configured fuel/air spray pattern and wherein the major axis is formed as a chordal line of the combustion chamber to conform the fuel/air mixture pattern from each of the fuel nozzles to the annular shape of the combustor chamber thereby to reduce the number of airblast atomizer fuel nozzles required to completely cover a predetermined diameter of combustion chamber annulus.

1 Claim, 5 Drawing Figures

FIG 6

ELLIPTICAL AIRBLAST NOZZLE

This invention relates to airblast nozzles and more particularly to airblast nozzles having an outlet configuration for producing a spread fuel/air mixture pattern for improved coverage of fuel/air distribution within an annular gas turbine engine combustor.

Various fan shaped or extended fuel/air mixtures have been proposed for injection of fuel/air mixtures into annular gas turbine engine combustors.

One approach includes provision of a nozzle slot for producing a fan configured atomized fuel stream into a combustor chamber. An example of such an arrangement is set forth in U.S. Pat. No. 3,759,448, issued Sept. 18, 1973, to Watkins. Other proposals have included modification of the outlet opening in an air assisted spray nozzle to produce a generally fan shaped fuel/air mixture for greater coverage of the fuel/air mixture in the upstream end of an annular combustion chamber. Such an arrangement is set forth in U.S. Pat. No. 3,521,824, issued July 28, 1970, to Wilcox. However, such spray patterns shape a liquid fuel pattern configuration which is then atomized at the nozzle outlet without passage through a pre-mix swirler chamber for improved nebulization.

For annular combustors, the ideal spray pattern theoretically has the same shape of an annular sector and yet retains the full fuel/air mixing thet is attributable to airblast atomizers of the type set forth in U.S. Pat. No. 3,713,588, issued Jan. 30, 1973, to Sharpe.

Accordingly, an object of the present invention is to improve airblast atomizer with swirl vanes and swirl chamber by provision of means at the outlet end of the swirl chamber from the airblast atomizer to form an elliptically configured fuel/air mixture into the upstream end of an annular gas turbine engine combustion with each of the airblast atomizers being arranged to have the elliptically configured fuel/air mixture flow therefrom arranged to produce a full coverage of fully mixed fuel and air constituents in the annular confines of the combustor apparatus.

Yet another object of the present invention is to provide an improved airblast atomizer having a swirl chamber located downstream of swirl vanes and a fuel spray nozzle producing a fuel/air spray pattern for mixture of fuel/air prior to injection into an annular combustor of a gas turbine engine and by the further provision of vortex formation means on the outer wall of the air blast atomizer to produce an elliptical fuel/air mixture pattern from the nozzle including a major axis along a chord line of an annular combustor chamber at the upstream end thereof and a minor axis that is generally arranged along the radial line between the inner and outer walls of the combustion chamber thereby to produce an improved coverage of fuel/air mixture within the annular combustion chamber.

Still another object of the present invention is to provide an improved airblast nozzle including a plurality of swirl vanes and a fuel spray orifice directed into a swirl chamber in the airblast nozzle upstream of the outlet opening therefrom to produce fuel/air mixture within the nozzle and wherein means are provided on the outlet tip at diametrically opposed areas thereof to establish spaced vortex patterns at the end of the swirl chamber for producing a spread of the fuel/air mixture therein along a major axis along the chord line of an annular combustion chamber formed by inner and outer annular walls and wherein the airblast nozzle includes an outlet shoulder thereon to produce a spray pattern along a minor axis arranged generally along radial lines between the inner and outer walls of the combustion chamber thereby to produce the full coverage of the full circumference of the annular combustion chamber by use of a reduced number of airblast nozzles.

Still another object of the present invention is to provide an improved elliptical airblast nozzle device including an internally located spray tube having outlet orifices at one end thereof injecting into a swirl chamber immediately upstream of an outlet end from the airblast nozzle and wherein a plurality of swirler vanes are supported between the inner tube and an outer annular housing of the airblast nozzle to produce a swirl of fuel/air mixture in a swirl chamber upstream of the outlet; the outer wall including a pair of diametrically opposed undercut slots formed therein having a radius greater than the radius of the inner wall of the outer tube forming the swirl chamber, the slots producing a vortex at the side of the nozzle for spreading the fuel/air mixture flow from the swirl chamber at the outlet of the nozzle along a major axis which is aligned along a chord line of the annulus of an annular combustion chamber having an annular inner wall and an annular outer wall and wherein the outer tubular housing of the airblast nozzle has a lesser radius at the sides thereof at points 90° from the major axis of wide spray from the airblast nozzle to produce a reduced width fuel/air spray pattern along a minor axis arranged generally along a radius line of the combustor between the inner and outer walls of the combustor, with the wide spray pattern and reduced width pattern of spray from the fuel nozzle defining an elliptical mixture of fuel and air to produce a fuller coverage of a predetermined arcuate extent of the annular combustion chamber between the inner and outer wall to better match the fuel/air flow pattern into the annular combustion chamber with a lesser number of airblast nozzles.

Further objects and advantages of the present invention will be apparent from the following description, reference being had to the accompanying drawings wherein a preferred embodiment of the present invention is clearly shown.

Figure 1:
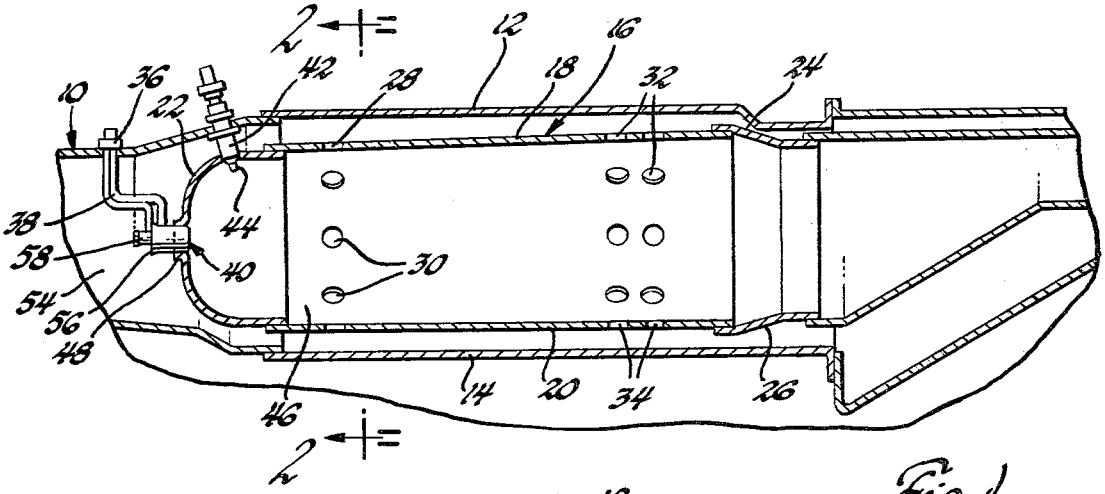
FIG. 1 is a longitudinal sectional view of an annular combustor chamber for use with the elliptical airblast nozzle of the present invention.

A typical arrangement for use of the present invention is shown in FIG. 1 that illustrates a somewhat simplified representation of a conventional combustor apparatus of the annular type for gas turbine aircraft engines. The engine 10 includes an annular outer wall 12 in an annular inner wall 14. Interposed between the space of the outer wall 12 and inner wall 14 of the engine 10 is a combustor apparatus 16 of an annular form having an outer annular liner wall 18 and an inner annular liner wall 20 joined at the leading edges thereof to an annular dome 22. A transition wall 24 is joined to the outer annular liner wall 18 and a like transition wall 26 is joined to the inner annular liner wall 20 to direct combustion products to a turbine nozzle downstream thereof.

The outer and inner annular liner walls 18, 20 can include primary combustion air openings 28, 30 therein and further downstream thereof secondary dilution air holes 32, 34 can be formed respectively in the liner walls 18, 20.

As shown in FIG. 1, a fitting 36 is located on the outer annular engine wall 12 at a point upstream of the annular dome 22. The fitting 36 has a fuel pipe 38 therefrom to supply an elliptical airblast nozzle 40 constructed in accordance with the present invention. An igniter 42 is located on the outer wall 12 and includes spaced electrodes 44 on the end thereof for starting a flame front within a primary combustion chamber 46 of annular form located downstream of outlet ends of a plurality of airblast nozzles 40.

Figure 2:
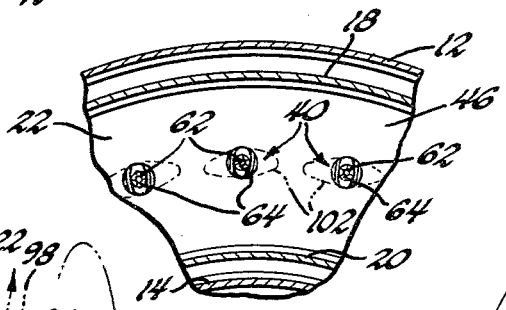
FIG. 2 is a vertical sectional view taken along the line 2—2 of FIG. 1 looking in the direction of the arrows.

Referring now to FIG. 2, it can be seen that a plurality of equidistantly circumferentially spaced elliptical airblast nozzles 40 are supported on the dome 22 about the annular combustion chamber 46 for directing a fuel-/air mixture therein for full coverage with a reduced number of nozzles while retaining full airblast nozzle operation including mixture of fuel and air within an internal nozzle swirl chamber prior to formation of an elliptical pattern into the combustor.

Figure 4:
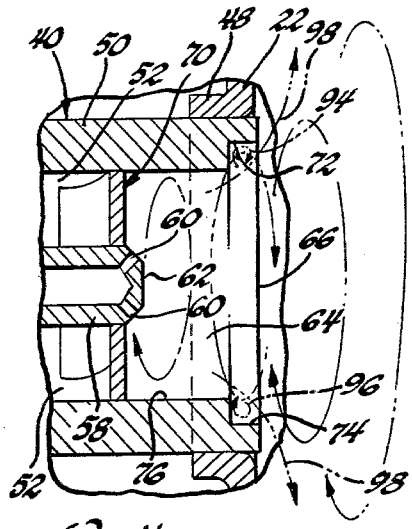
FIG. 4 is an enlarged, fragmentary cross-sectional view at the end of the nozzle along the lines 4—4 of FIG. 3 looking in the direction of the arrows.
Figure 3:
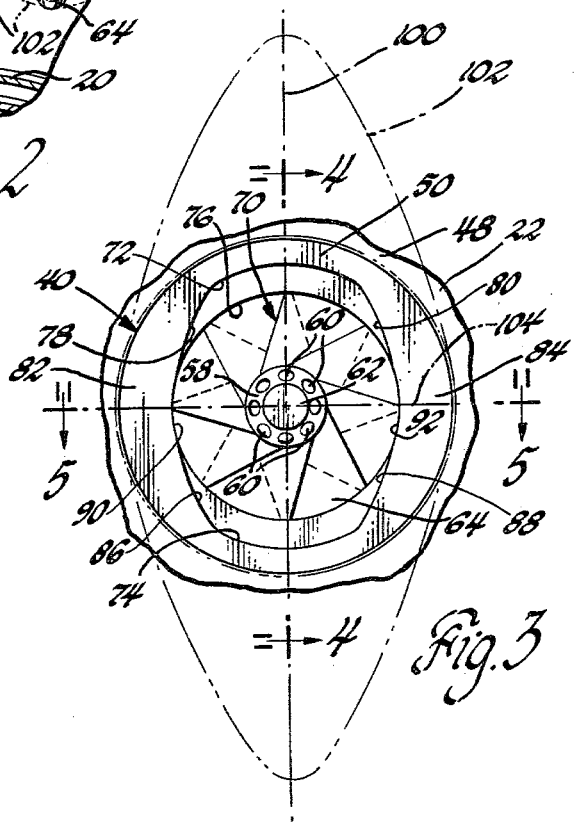
FIG. 3 is an enlarged end elevational view of an elliptical airblast nozzle in accordance with the invention.
Figure 5:
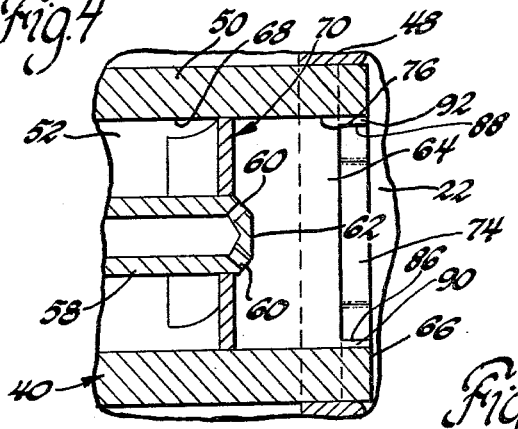
FIG. 5 is a fragmentary cross-sectional view taken along the line 5—5 of FIG. 3 looking in the direction of the arrows.

Referring now to FIGS. 3 and 4, the annular dome 22 has a forwardly projecting ferrule 48 therein for defining a circular opening for supporting each of the fuel nozzles 40 which in turn acts as a partial support for the forward end of the combustor apparatus 16.

Each of the elliptical airblast nozzles 40 includes a generally cylindrical outer shell or ring 50 that defines the outer wall of an annular air passage 52 that has an open end in communication with an air diffuser space 54 for receiving air from an upstream air supply compressor for the gas turbine engine 10. More particularly, the outer shell 50 includes a bell mouthed inlet end 56 thereon for directing air from the space 54 interiorly of the elliptical airblast nozzle 40. The fuel pipe 38 is connected to one end of a fuel supply tube 58 located concentrically of the annular air passage 52 within the nozzle 40. The fuel supply tube 58 includes a plurality of fuel supply orifices 60 in a closed end 62 of the tube 58 for directing a fuel/spray pattern into a swirl chamber 64 of the nozzle 40 located immediately upstream of an open outlet end 66 thereof that communicates with the combustion chamber 46. The inner surface 68 of the outer shell of ring 50 is joined to the fuel supply tube 58 adjacent the closed end 62 thereof as best shown in FIG. 4 by a ring of swirl vanes 70 which impart a substantial circumferential or tangential component of velocity to the air flow through the passage 52 into the swirl chamber 64 at the outlet end 66 of each of the nozzles 40.

In the operation of the illustrated device, air flow through the passage 52 is in the order of three hundred to four hundred feet per second at full engine power and flows past the downstream end of the outer surface of the fuel supply tube 58 at approximately the same velocity but with a substantial swirl component. Such air flow blows away and thoroughly mixes the fuel/spray pattern from the orifices 60 to produce a nebulized fuel/air mixture within the swirl chambers 64.

The use of such main nebulized fuel and air flow is improved by the present invention in that it is spread in a particular manner to fill a substantial arcute extent of the annular combustion chamber 46 as soon as it passes through the outlet end 66 of each of the nozzles 40.

To accomplish this objective, and to better match the flow of nebulized mixed fuel/air flow from the outlet end 66 into the annular combustion chamber 46, the outer shell or ring 50 has a pair of diametrically opposed undercut end slots 72, 74 formed therein at a radius which is greater than the radius of the inner wall 76 of the outer ring 50 in the vicinity of the outlet end 66 from each of the nozzles 40. The end slot 72 includes opposite ends 78, 80 thereon that merge with a solid side segment 82 and solid side segment 84 of the outer surface of the outer shell or ring 50. Like opposite ends are formed at 86 and 88 on the end slot 74 on the opposite side of the outlet end 66 of each of the nozzles 40.

Additionally, the outlet end 66 of each of the nozzles has side wall portions 90, 92 on the inner wall 76 which serve to control the nebulized fuel/air mixture from the solid upper and lower portions of the outer ring 50.

The illustrated diametrically opposed end slots 72 and 74 are configured to produce an acrcuate plurality of vortex rings 94 as shown in FIG. 4 at one side of the nozzle outlet end 66 and a second plurality of vortex rings 96 on the opposite side of the outlet end 66 of the nozzle 40. Each of the vortex ring patterns 94, 96 cause a swirling flow path 98 within the swirl chamber 64 to be directed as a widened spray pattern and to flow radially outward of the swirl chamber 64 on both sides of the outlet end 66 of the nozzle to define a major axis 100 of a generally elliptically configured fuel/air mixture from the outlet end 66. Since the vortex rings 94, 96 are located in local areas of the outlet end 66 at points more or less 180° or diametrically opposed from one another, the flow pattern is selectively spread to produce the major axis 100 of the elliptically configured fuel/air mixture pattern 102 that flows into the combustion chamber 46 at each of the elliptical air blast nozzles 40.

The side wall portions 90, 92 of the outer ring 50 produce a narrow width flow pattern from the outlet end 66 at a point perpendicular to the major axis so as to define a minor axis 104 of the elliptically configured flow pattern 102. In the illustrated arrangement, each of the nozzles 40 is connected to the annular dome 22 so as to cause axes 100 to be located on chord lines of the annular combustion chamber 46. Likewise, the minor axis of each of the nozzles is located along a generally radial line of the combustion apparatus 16 between the inner and outer annular liner walls 18, 20 thereof. The resultant pattern of fuel flow into the combustion chamber is matched to the annular shape of the combustion chamber 46 so as to reduce the number of airblast nozzles that are required for full coverage of the complete circumference of a predetermined diameter combustor apparatus with nebulized fuel/air to improve fuel distribution and combustion thereof.

While the embodiments of the present invention, as herein disclosed, constitute a preferred form, it is to be understood that other forms might be adopted.

The embodiments of the invention in which an exclusive property or privilege is claimed are defined as follows:

1. An airblast nozzle for an annular combustor comprising: an air supply ring including an air inlet end for receiving compressed air from an air supply compressor and a nozzle outlet end, a fuel supply tube located concentrically of and coaxially along the air supply ring and including a plurality of fuel spray orifices, means defining a mixing swirl chamber upstream of said nozzle outlet end and downstream of said orifices to receive fuel therefrom, a plurality of air swirler vanes located in surrounding relationship to said fuel supply tube at a point upstream of said fuel spray orifices for producing an air swirl of progressive radius within said swirl chamber for mixing air and fuel therein, said nozzle outlet end having a pair of undercut slots therein extending along generally greater radius lines than the inside diameter of said nozzle outlet end and operative to produce a plurality of radial vortices along both of said slots operative upon the swirl pattern to produce a flared wide angle spray cone issuing from said nozzle outlet end to define a major axis of a distribution pattern within an annular combustor, and said nozzle outlet end having side portions thereon with a radius corresponding to that of the inside diameter at the swirl chamber to produce a reduced width fuel/air flow from the nozzle defining a minor axis of an elliptically configured fuel-/air flow pattern into the annular combustor wherein the spray pattern from the nozzle will conform the fuel/air mixture to the arcuate extent of the annular combustor for producing a uniform flame front pattern therein.

* * * * *